United States Patent [19]

Johnson, Sr.

[11] Patent Number: 4,737,998

[45] Date of Patent: Apr. 19, 1988

[54] CELLULAR WATERBED MATTRESS ASSEMBLY

[76] Inventor: Arthur K. Johnson, Sr., 5365 S. Country Club Way, Tempe, Ariz. 85283

[21] Appl. No.: 915,667

[22] Filed: Oct. 6, 1986

[51] Int. Cl.[4] ..... A47C 27/10

[52] U.S. Cl. ..... 5/422; 5/451; 5/455

[58] Field of Search ..... 5/451, 422, 450, 455, 5/449, 465

[56] References Cited

U.S. PATENT DOCUMENTS

| | | | |
|---|---|---|---|
| 4,077,074 | 3/1978 | Fogel | 5/481 |
| 4,149,286 | 4/1979 | Fogel | 5/484 |
| 4,167,049 | 9/1979 | Fogel | 5/451 |
| 4,221,013 | 9/1980 | Echevarria | 5/455 |
| 4,281,425 | 8/1981 | Jacobs | 5/455 |
| 4,534,078 | 8/1985 | Viesturs et al. | 5/451 |

FOREIGN PATENT DOCUMENTS

| | | | |
|---|---|---|---|
| 2435245 | 4/1980 | France | 5/465 |
| 1545325 | 5/1979 | United Kingdom | 5/455 |

*Primary Examiner*—Alexander Grosz
*Attorney, Agent, or Firm*—Herbert E. Haynes, Jr.

[57] ABSTRACT

A waterbed mattress is provided with a plurality of separate, free-standing cells, arranged in a "honeycomb" pattern. The cells are preferably hexagonal in plan. Each cell is provided with its own fill valve and is removably encased in its own protective waterproof pouch. The cells are held together by a cover member such as fitted sheet or a conventional zippered mattress cover. In the preferred embodiment of the invention, the cells are arranged in rows and columns on an insulating substrate having upstanding end portions alignable with the head and foot of a bed frame. Each upstanding end has a plurality of cut-out portions defining a jagged inner edge for receiving the corners of the hexagonal cells. The mattress assembly may also be provided with a heating unit comprising a plurality of heating pads electrically connected in parallel with one another and having a temperature control unit.

6 Claims, 2 Drawing Sheets

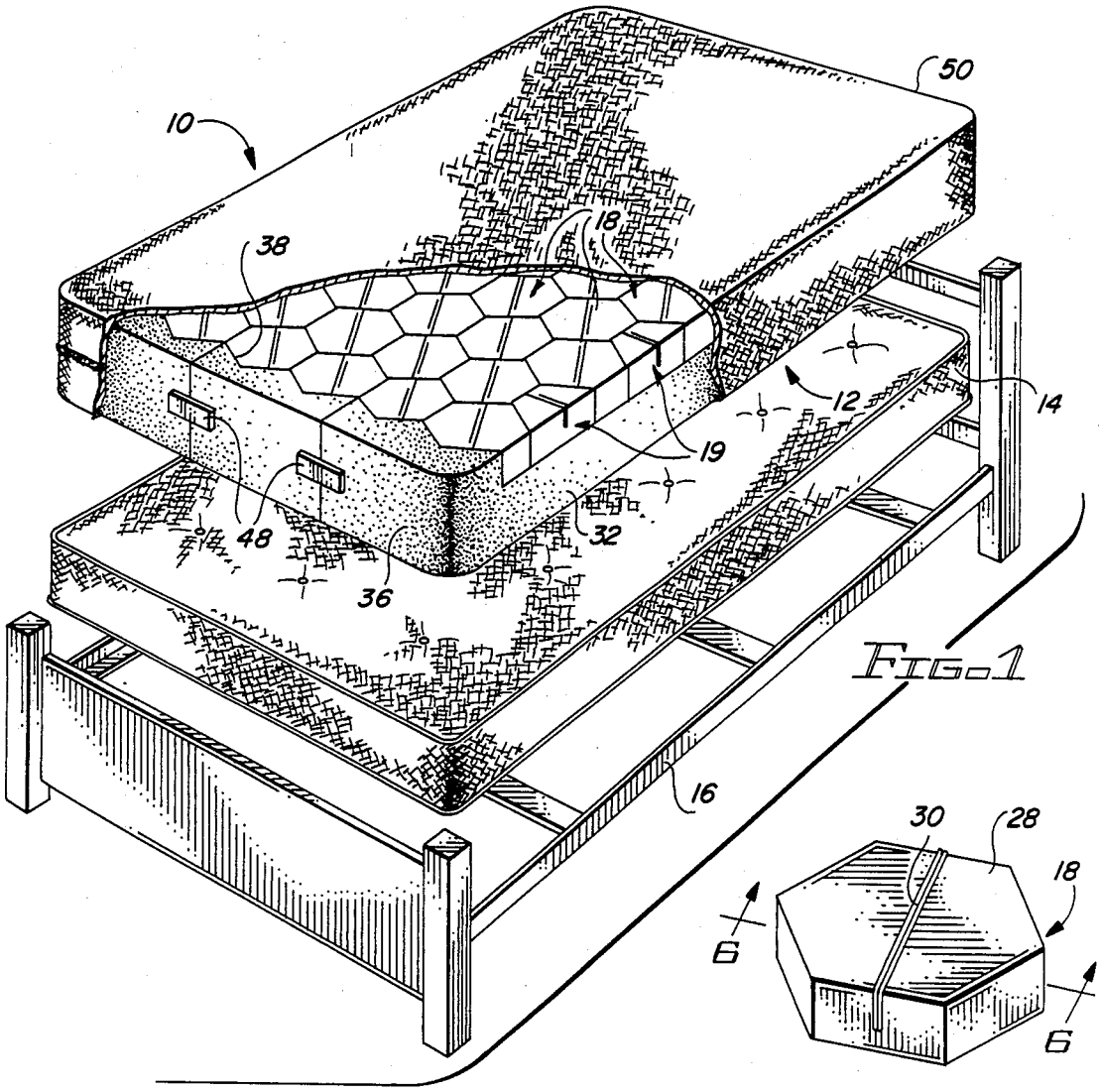
FIG. 1
FIG. 4
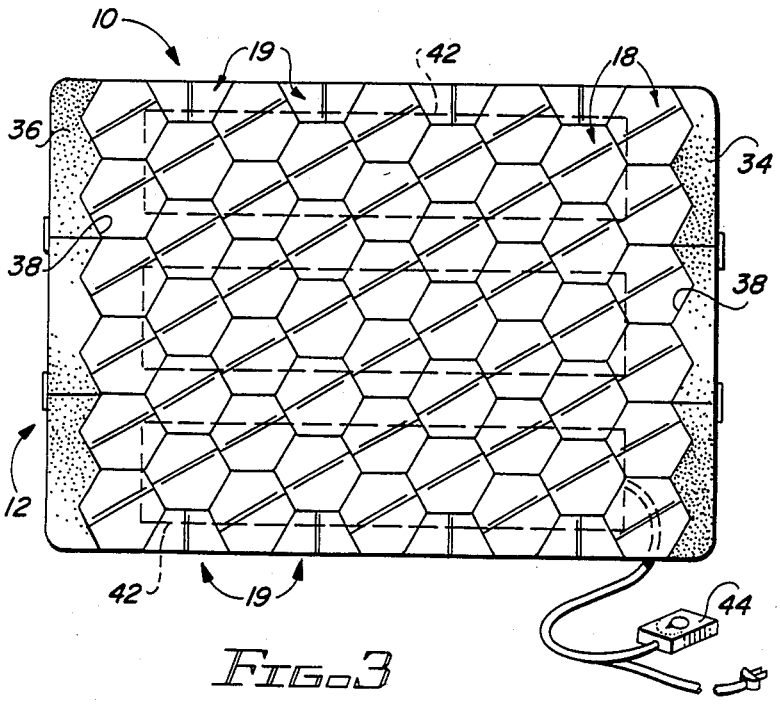
FIG. 3
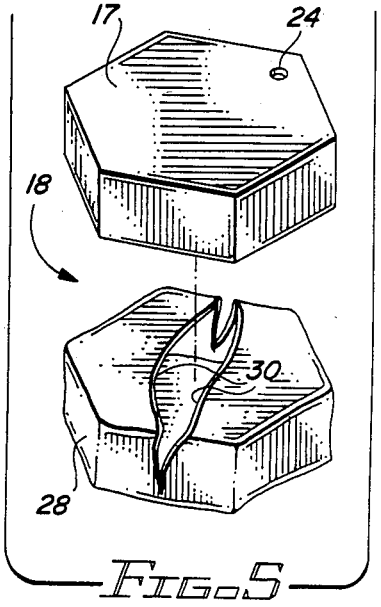
FIG. 5

CELLULAR WATERBED MATTRESS ASSEMBLY

BACKGROUND OF THE INVENTION

1. Field of the Invention

This invention is in the field of waterbed mattresses, particularly mattresses made up of a plurality of individual cells, with no fluid communication between cells.

This invention is related to my co-pending application number 06/896,770 filed Aug. 14, 1986, entitled "WATERBED HEATER".

2. Description of the Prior Art

Numerous changes have been made in the construction of the waterbed mattress since the waterbed was first introduced in the 1960's. The original waterbed mattresses consisted of a single, large, flexible bladder which would be filled with water or other liquid and supported in a sturdy support frame. A sheet of waterproof liner material would be placed between the mattress and the frame in order to protect the frame and the adjacent area from water damage in the event of mattress leakage. These mattresses gained widespread popularity with college students, but were not immediately accepted by the general public because the bladders were subject to wave motions and continuing oscillating responses to relatively small motions, which most people found disturbing and uncomfortable. In addition, the mattresses when filled often weighed upwards of 500 lbs. which made them impossible to move from one room of a house to another. Still another problem was that when leakage occured it would be necessary to empty the mattress completely, patch the mattress and then refill it. In addition, the amount of water involved in such a leak could result in substantial water damage to the surroundings, and would be extremely difficult to clean up. Furthermore, the total weight of the frame, bladder and water often exceeded the permissible floor loading in residential structures, which resulted in the practice of prohibiting waterbeds in many apartments.

In response to consumer fears and complaints about the excessive wave motions and oscillations of conventional waterbed mattresses, numerous mattresses have been developed which incorporate complicated baffle structures or other motion damping systems for reducing wave action. Exemplary mattresses with dampening constructions are disclosed in U.S. Pat. No. 4,168,555 to Benjamin, U.S. Pat. No. 4,204,289 to Fogel, U.S. Pat. No. 4,296,510 to Phillips, U.S. Pat. No. 4,310,936 to Benjamin, U.S. Pat. No. 4,517,691 to Philips, U.S. Pat. No. 4,577,356 to Johenning et al, U.S. Pat. No. 4,430,764 to Finkelstein, and U.S. Pat. No. 4,475,257 to Phillips. These reduced-motion mattresses have more of the look and feel of conventional inner spring or foam bed mattresses, yet retain the more even weight distribution and the beneficial "floating" feeling for which the earlier waterbed mattresses were praised. As a result, the popularity of waterbeds has increased tremendously in recent years, resulting in their acceptance among all segments of the population.

However, although the complicated baffle constructions disclosed in the aforementioned patents solve the problem of excessive wave motion in the mattress, they do nothing to alleviate the problems of weight and leakage. In fact, the baffles tend to increase the weight of the waterbed mattress, as well as add to the cost and complexity of manufacturing.

One mattress which has been designed in an attempt to solve the weight and leakage problems, as well as the problem of wave motion, is disclosed in U.S. Pat. No. 4,221,013 to Echevarria. The Echevarria mattress comprises a plurality of individual tubes supported in a cavity defined by pairs of foam panel members, with conventional liner material placed below the tubes to protect the bed frame and adjacent areas. The individual tubes do not transmit significant side forces or wave motion to the other tubes, and thus provide a steadier sleeping surface than the conventional single-bladder mattress. In addition, the individual tubes can be removed from the bed for relatively easy filling and draining. Also when leakage occurs, it is necessary only to repair or replace a single leaky tube rather than to remove an entire bulky bladder for patching. Nevertheless, the mattress of Echevarria suffers from several drawbacks. First of all, although the tubes do not transmit side forces to one another, waves are still free to travel longitudinally from one end of a tube to the other end. Thus, some oscillating motion is still felt. In addition, the individual tubes are designed to hold approximately 50 lbs. of water. Although this obviously makes then easier to transport than the conventional bladders averaging 500 lbs., they are still heavier than desirable for the average consumer. Furthermore, the foam panel members, which are required on all sides of the mattress to prevent the tubes from rolling apart and to define a cavity for collecting water should a leak occur, increase the cost of the waterbed ensemble and are bothersome to store and transport when the waterbed is to be moved to a new location. Also, although the amount of water involved in a leak will be less than in a conventional bladder type mattress, the leak will still be difficult to clean up since the water will tend to spread out over the entire surface of the unitary liner. Still another problem of the aforementioned mattress is that, since there is no fluid communication between the individual tubes, heat transfer between tubes is poor. Thus, a conventional waterbed heating unit, consisting of a single heating pad placed under the center of the mattress, will not satisfactorily heat those tubes which are located farthest from the center.

Finally, in addition to their use by private consumers, waterbeds are increasingly being used by hospitals, especially in the treatment of burn victims, paraplegics, and other immobilized patients who are subject to bedsores. The uniform weight distribution afforded by water-filled mattresses eliminates regions of high pressure under a patient's body, thus preventing bedsores from forming. However, like the waterbeds designed for consumer use, the waterbeds designed for hospital use have been far too heavy to be practical. In addition, it is generally desirable for hospital beds to be adjustable so that the patient can elevate parts of his or her body relative to other parts. None of the prior art mattresses have been found suitable for use on adjustable beds, since the water tends to run "downhill" from the elevated to the level portion of the bed, resulting in uneven pressure distribution.

Thus, there exists a longfelt need in the art for a new and improved waterbed mattress with reduced wave motion, which is easy to transport and fill, minimizes leakage and which is suitable for use on adjustable beds.

SUMMARY OF THE INVENTION

The present invention overcomes the aforementioned shortcomings of the prior art by providing a waterbed mattress with a plurality of individual unattached "honeycomb" cells arranged in rows and columns over a support surface. Each cell is contained in its own waterproof pouch for confining leaks to a small area, thus eliminating the need for a large unitary liner sheet under the entire mattress. In addition, each cell is freestanding, so foam support members are not required for supporting all four sides of the mattress. A conventional mattress cover is sufficient to hold all the cells together, thus eliminating the need for a conventional hard-sided waterbed frame.

Each cell is further provided with its own filler valve, so that the cells may be filled and emptied independently of one another. Preferably, the dimensions of the cells are small enough so that each cell weighs about six pounds. Thus, when setting up the bed, the user can easily carry each cell individually to a bathtub or sink, fill it, and place it on a frame. In addition, some of the cells may be filled to a different level than others, so that one side of the bed may be firmer than the other, in order to accommodate two sleepers having different preferences, or to provide a hospital patient with more support under injured body parts than under uninjured parts.

Because the individual "honeycomb" cells are arranged in rows and columns, there is no tendency for waves to be transmitted in either a longitudinal or a lateral direction. Any motion generated in one cell is confined to that cell rather than continued through neighboring cells. In addition, the arrangement makes the mattress ideal for adjustable beds, since the individual cells can be elevated or lowered relative to one another without all the water running "downhill" to another portion of the bed.

The problem of limited heat transfer between the cells is overcome by providing the mattress with a plurality of heating pads connected in a parallel to a single control-unit. A heating unit of this type is fully disclosed in my co-pending U.S. patent application No. 06/896,770, hereby incorporated by reference.

Accordingly, it is an object of this invention to provide a waveless waterbed mattress with a "honeycomb"-like structure consisting of a plurality of individual cells with no fluid communication between cells.

Another object of the invention is to provide a waterbed mattress with a plurality of individual lightweight and portable cells, each cell having its own fill valve for filling and draining the cells independently of one another.

Still another object of the invention is to provide a waterbed mattress with a plurality of individual cells, each cell being contained within its own waterproof pouch for confining any leaks to a small area.

Still another object of the invention is to provide a waterbed mattress which is suitable for use on adjustable beds.

Still another object of the invention is to provide a waterbed mattress having a plurality of individual cells with a plurality of heating pads for uniformily heating all portions of the bed.

Yet another object of the invention is to provide a waterbed mattress with a plurality of freestanding cells which do not require the support of a conventional hard-sided waterbed frame.

The foregoing and other objects of the present invention as well as the invention itself, may be more fully understood from the following description when read in conjunction with the accompanying drawings.

BRIEF DESCRIPTION OF THE DRAWINGS

FIG. 1 is a perspective view showing a preferred embodiment of the waterbed mattress in exploded relation to a conventional boxspring and bed frame.

FIG. 3 is a top view showing the mattress of the present invention.

FIG. 4 is a perspective view showing one of the individual inner cells of the mattress encased in its protective pouch.

FIG. 5 is a perspective view showing one of the individual inner cells of the mattress in exploded relation to its protective pouch.

DETAILED DESCRIPTION OF THE INVENTION

FIG. 1 shows the cellular "honeycomb" mattress of the instant invention, generally indicated by the numeral 10, assembled on an insulating substrate 12 and placed on a conventional boxspring 14 and bed frame 16. The mattress need not be supported as shown, but may also be supported on an adjustable hospital bed, a hard-sided waterbed frame as is well known in the art, or even placed on the floor. However, the conventional boxspring and regular bed frame are thought to be preferable to the hard-sided waterbed frame since most conventional beds allow the consumer to use the full sleeping surface of the mattress while a hard-sided waterbed frame keeps the user away from the edges of the bed. In addition, since most consumers already own conventional boxsprings and bed frames, they would be spared the additional expense of purchasing a special waterbed frame.

Figure 7:
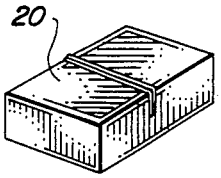
FIG. 7 is a perspective view showing an alternative embodiment of one of the cells of the mattress.
Figure 8:
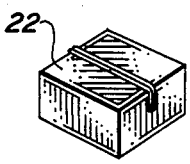
FIG. 8 is a perspective view showing another alternative embodiment of one of the cells of the mattress.
Figure 9:
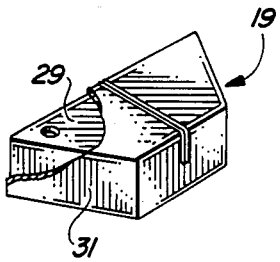
FIG. 9 is a perspective view, partially broken away, showing one of the semi-hexagonal cell assemblies to be used in conjunction with the hexagonal cell assembly shown in FIGS. 4 and 5.

The mattress 10 is made up a plurality of individual cell assemblies 18 arranged in a "honeycomb" pattern. The assemblies include an inner cell 17 and a waterproof pouch as will hereinafter be described in detail. The inner cells 17 are made from a pliant but substantially non-stretchable material such as vinyl or other conventional waterbed mattress material. Preferably, each of the cell assemblies 18 is hexagonal in plan with the exception of the cells at the longitudinal sides of the bed, which must be semi-hexagonal in plan, as shown at 19, in order to keep the sides of the mattress straight and even. The hexagonal geometry has been found to result in the optimum packing arrangement for the individual cells of the mattress, since all of the sides of all of the cells lend maximum support to one another, resulting in a firm sleeping surface without need for any additional support structure. In addition, with this configuration, the sides of the cells have less tendency to bulge and distort than in other configurations. Nevertheless, it is not strictly necessary that the cells be hexagonal. Rectangular cells 20 as shown in FIG. 7, or cubes 22 as shown in FIG. 8, or any other cell having a plurality of planar sides may be used.

The exact dimensions of the individual cells are not critical. However, excellent results have been obtained when the cells are constructed as regular hexagons measuring approximately 7" on each side and approximately 3" high. With these dimensions, each individual cell weighs less than 6 lbs. when filled with water. This makes the cells extremely easy to transport between the bedroom and bathroom, kitchen or outdoor water supply where they can be individually filled or emptied. In addition, the 3" height of the cells makes heating of the mattress more efficient, since the heater has to heat a much smaller column of water than is present in a conventional waterbed mattress, which is typically 9" high. The manufacturer may of course, choose to make the dimensions of the cells either larger or smaller; the only limitation is that each cell should be small enough so that it bears only a portion of the weight of a user. In general, the smaller the cells, the less oscillation or wave motion generated throughout the mattress.

Each inner cell 17 has its own fill valve 24 of the type which is well known in the art. In addition, each inner cell 17 may contain a slab of resilient fill material such as convoluted foam or sponge 26 of the type disclosed in U.S. Pat. No. 4,411,033 to Morgan. The foam or sponge, which is substantially submerged in, yet partially suspended in, the liquid fill of the inner cell 17, serves to further dampen any wavelike motion and to soften the user's initial contact with the mattress, thus improving the comfort characteristics of the waterbed.

Figure 2:
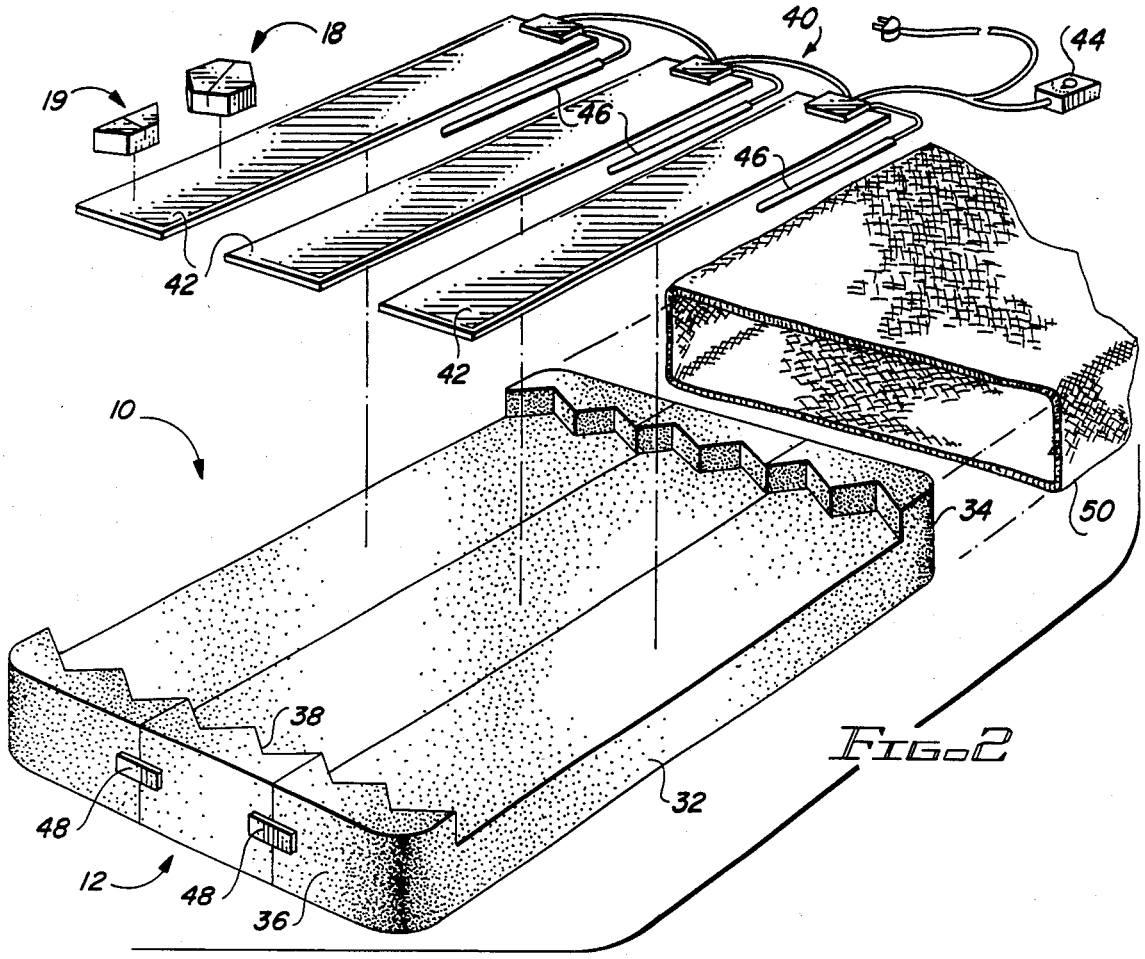
FIG. 2 is an exploded view in perspective showing the mattress together with a preferred heating element and a foam insulation member.
Figure 6:
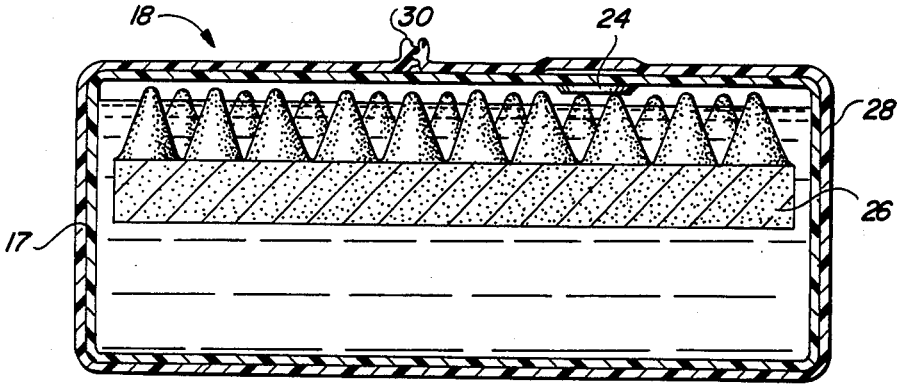
FIG. 6 is an enlarged sectional view taken through line 6—6 of FIG. 4.

Each hexagonal cell assembly 18 of the mattress preferrably further includes its own individual waterproof pouch 28 which confines any leakage to a very small volume if one of the inner cells 17 should be punctured or otherwise damaged. Each pouch 28 is provided with its own seal means, such as the interlocking rib and groove arrangement 30 shown in FIG. 6, for insuring that the pouch is fluid-tight. Similarly, each semi-hexagonal cell assembly 19 includes an inner cell 29 and a waterproof pouch 31.

In the preferred embodiment of the invention, substrate 12, which is made of a heat-insulating material such as foam or cork, is split into three sections for easy storage and trasport, each section comprising a flat bottom portion 31 and two intergral upstanding end portions 34, 36 for positioning at the head and foot, respectively, of the bed. Each end portion has a plurality of cut-out areas 38 defining a jagged inner edge for receiving the corners of hexagonal cell assemblies 18. The purpose of the upstanding end portions 34, 36 is to provide the user with guide means for properly positioning the cells, and also to provide a straight edge at the head and foot of the bed. Thus, in other embodiments of the invention using rectangular cells 20 or cubes 22, upstanding ends 34 and 36 would not be required since the edges of the mattress would already be straight, and positioning of the cells would be self-explanatory.

The mattress assembly 10 preferably also includes a heating unit 40 comprising a plurality of heating pads 42 connected in parallel to one another and to a temperature control unit 44. Each heating pad 42 has its own associated heat sensor 46. The heating pads 42 may be controlled together so that the temperature throughout the mattress is uniform, or they may be controlled separately so that one part of the mattress can be made hotter or colder than other parts, depending on what kind of control circuit is used. The heating unit 40, along with exemplary control circuits, is fully disclosed in my co-pending U.S. patent application No. 06/896,770, hereby incorporated by reference. A single heating pad could also be used, but heat transfer throughout the mattress would tend to be less satisfactory with a single pad due to the lack of fluid communication between the honeycomb cells, and "hot spots" would inevitably result. Since the heating pads disclosed in co-pending U.S. patent application No. 06/896,770, are preferably provided with a built-in heat-insulation layer, the user may choose to eliminate insulating substrate 12 from the mattress assembly. Conversely, the user may choose to keep insulating substrate 12, and to use a plurality of heating pads joined together as disclosed in U.S. patent application No. 06/896,770, but without the built-in layer of insulation in the heating pads. For maximum energy efficiency, however, the user should employ both insulation 12 and the heating pads with the built-in insulating substrate, as this will almost totally eliminate heat loss through the bottom of the mattress.

To assemble the preferred embodiment of the mattress, the user first places the split portions of substrate 12 on a support surface such as a boxspring 14 or a pedestal of a conventional waterbed mattress (not shown) or the floor, and joins the split portions together using releasable attachment means 48, such as a suitable hook and loop type fastener of the kind marketed under the trademark Velcro. Next, the heater unit 40 is placed on substrate 12. The user then fills one of the inner hexagonal cells 17 using the nearest convenient water source, and places the cell in its protective waterproof pouch 28, closing the pouch with sealing means 30. After the cell assembly 18 has been positioned on substrate 12 so that one of its corners is received in one of the cut-out areas 38 in upstanding end portion 34 or 36 of substrate 12, another cell 18 is filled, sealed in a protective pouch 28, and placed alongside it. Other hexagonal cell assemblies 18 are filled and positioned in a similar manner until one complete row of cells has been completed. A second row of hexagonal cell assemblies 18 is now arranged on the substrate 12 such that one corner of each hexagonal cell assembly 18 in the second row is received between the corners of two adjacent hexagonal cells 18 in the first row. The second row should begin and end with a semi-hexagonal cell assembly 19 having its wide end flush with the side of the substrate 12 so that the ends of the mattress are even. Successive rows should follow the pattern of the first two rows, with every other row beginning and ending with a semi-hexagonal cell assembly 19. When all of the cell assemblies 18 have been positioned on the substrate 12, a covering member 50 such as a conventional zippered mattress cover is placed over the cell assemblies 18 and the substrate 12 for holding the assembly together. The covering member 50 may be transparent if the user finds the "honeycomb" pattern of the mattress aesthetically appealing, or it may be opaque if the user wants to "camouflage" the assembly as a conventional mattress.

It should be understood that although the term "waterbed" has been used throughout this disclosure, the fluid filling of the mattress need not be limited to water, but can also include gasses such as air, gels, or liquids such as aqueous compositions including germicides, fungicides, viscosity modifiers and/or additives for enhanced heat transfer.

While the principles of the invention have now been made clear in the illustrated embodiments, there will be immediately obvious to those skilled in the art, many modifications of structure, arrangements, proportions, the elements, materials and components used in the proactice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A fluid-filled mattress assembly comprising:

a planar substrate member of rectangular configuration having a top and bottom surface and two spaced apart parallel longitudinal edges for positioning at the opposite sides of a bed;

a first upstanding end portion integral with said substrate member for positioning at one end of a bed;

a second upstanding end portion integral with said substrate member for positioning at the other end of a bed;

a plurality of separate cells for containing fluid, each of said cells being an upstanding structure having a planar top and a planar bottom surface, a plurality of planar sides and a plurality of corners, said cells arranged in free-standing non-connected adjacent and abutting relationship with respect to each other to cooperatively form a plurality of rows and columns on said substrate member with each of said rows and columns having at least two of said separate cells therein, each of said cells being sufficiently small to bear only a portion of the weight of the user and limiting interaction of pressure and wave motion between the cells; said first and second upstanding end portions each having a plurality of cut-out areas defining a jagged inner edge for receiving the corners of the cells arranged along the end portions of the substrate member and a one piece mattress cover of thin flexible material defining an internal cavity in which said cells and said substrate member are encasingly contained.

2. The fluid-filled mattress assembly of claim 1, further comprising a heating unit positioned between said substrate member and said plurality of cells.

3. The fluid-filled mattress assembly of claim 2, in which said heating unit comprises a plurality of heating pads electrically joined in parallel with one another and having a temperature control unit.

4. The fluid-filled mattress assembly of claim 1, in which each of said cells is removably encased in its own waterproof pouch for confining leakage to a small area.

5. The fluid-filled mattress assembly of claim 1, in which all of the cells along the head and foot edges of said substrate member and in the interior portion of the mattress are hexagonal in plan, and in which the cells at the side edges of every alternate row are semi-hexagonal in plan.

6. The fluid-filled mattress assembly of claim 1, in which said substrate member is made of heat insulation material.

* * * * *